United States Patent [19]

Haruhara

[11] Patent Number: 4,508,462

[45] Date of Patent: Apr. 2, 1985

[54] PRINTING APPARATUS WITH COMPUTER CONTROL OF IMPRESSING A PRINT SETTING MARK ON A RECORDING SHEET FOR REALIGNMENT

[75] Inventor: Kazuyoshi Haruhara, Futsusa, Japan

[73] Assignee: Casio Computer Co., Ltd., Tokyo, Japan

[21] Appl. No.: 587,388

[22] Filed: Mar. 8, 1984

Related U.S. Application Data

[63] Continuation-in-part of Ser. No. 402,762, Jul. 28, 1982, abandoned.

[30] Foreign Application Priority Data

Sep. 25, 1981 [JP] Japan ..... 56-142249[U]

[51] Int. Cl.[3] ..... B41J 3/42

[52] U.S. Cl. ..... 400/70; 400/582; 364/900

[58] Field of Search ..... 400/70, 124, 43, 63, 400/582, 583, 279; 364/519, 900, 200; 101/93.05

[56] References Cited

U.S. PATENT DOCUMENTS

| | | | |
|---|---|---|---|
| 3,710,913 | 1/1973 | Brennan, Jr. et al. | 400/70 |
| 3,930,570 | 1/1976 | Fletcher | 400/70 |
| 4,270,865 | 6/1981 | Konishi | 400/63 |
| 4,277,190 | 7/1981 | Rudy et al. | 400/582 |
| 4,277,191 | 7/1981 | Davis et al. | 400/582 |
| 4,396,307 | 8/1983 | Shah et al. | 400/582 |
| 4,452,136 | 6/1984 | Boynton et al. | 400/70 X |
| 4,459,052 | 7/1984 | Lundblad | 400/124 |
| 4,468,140 | 8/1984 | Harris | 400/124 |

FOREIGN PATENT DOCUMENTS

| | | | |
|---|---|---|---|
| 2913513 | 10/1980 | Fed. Rep. of Germany | 400/70 |
| 2026392 | 2/1980 | United Kingdom | 400/582 |

OTHER PUBLICATIONS

"Printer Data Processing/Word Processing Enhanced Controller System", IBM Tech. Disc. Bulletin, vol. 24, No. 11B, Apr. 1980, pp. 5885-5887.

*Primary Examiner*—E. H. Eickholt

*Attorney, Agent, or Firm*—Frishauf, Holtz, Goodman & Woodward

[57] ABSTRACT

A printing apparatus includes an electronic cash register body provided with a keyboard including entry keys and subtotal-closing key. An associated central processing unit includes registers for storing data to be printed and sends printing data furnished by key operation. When the subtotal-closing key is actuated, a recording sheet held in a printing section is caused to move forward a pre-determined distance after printing is completed, and a setting mark is printed on the recording sheet. The setting mark allows the recording sheet to be aligned with the printing section so that printing will continue from the next successive data line when the recording sheet is reinserted in the printing section.

7 Claims, 7 Drawing Figures

FIG. 1
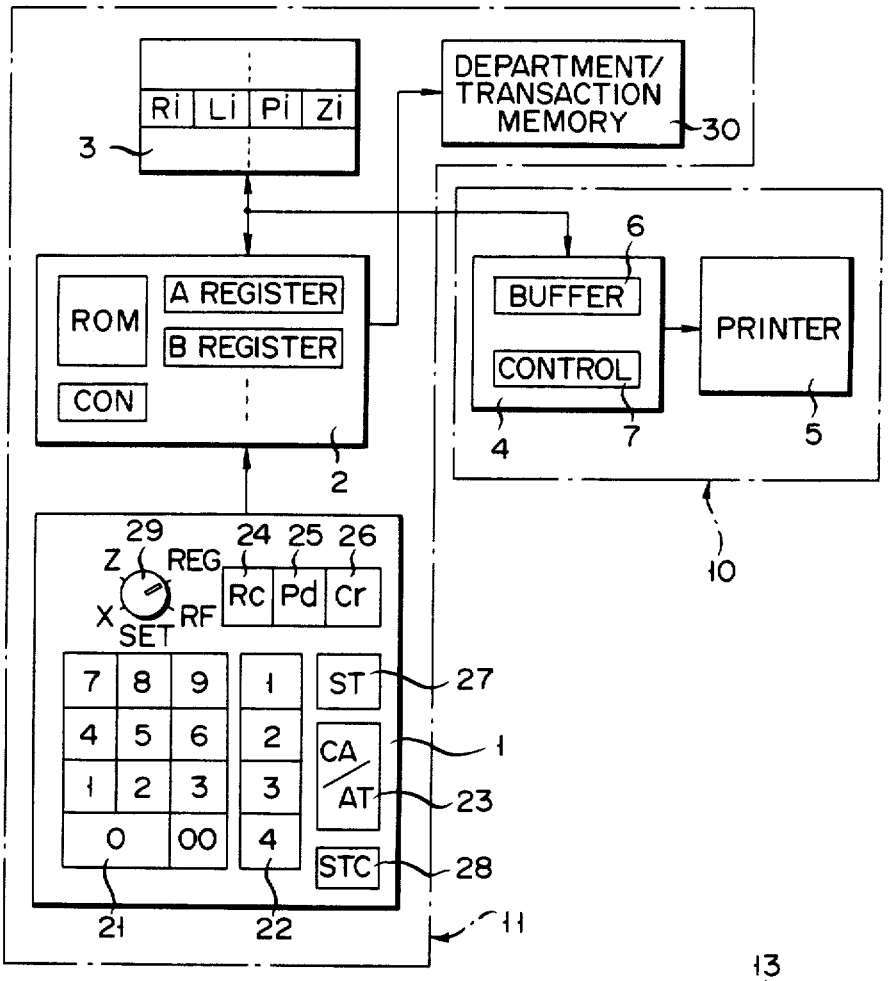
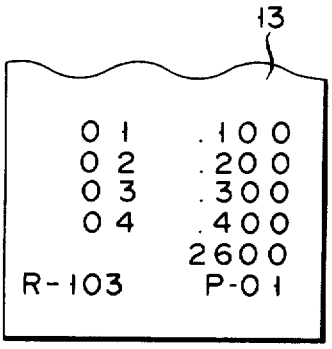
FIG. 4

PRINTING APPARATUS WITH COMPUTER CONTROL OF IMPRESSING A PRINT SETTING MARK ON A RECORDING SHEET FOR REALIGNMENT

CROSS REFERENCE TO RELATED APPLICATION

The present application is a continuation-in-part of application Ser. No. 402,762, filed July 28, 1982 now abandoned.

BACKGROUND OF THE INVENTION

This invention relates to a printing apparatus which allows a recording sheet such as a slip to be removed prior to completion of printing on the sheet and more particularly to a printing apparatus which indicates the point at which printing should be resumed, after the recording sheet has been reloaded in the apparatus.

When printing on a recording sheet of a prescribed size as the sheet is set in a printer of an electronic register, it is sometimes desired to carry out a sub-totaling operation during printing, remove the recording sheet from the printer, and resume printing on the recording sheet after it is reloaded. Printing of a bill statement or tab at a restaurant is one concrete instance of such intermittant printing. When a restaurant guest makes an additional order, the restaurant register operator must reload the tab on the register printer to continue printing. In such case, the tab should be shifted to such a point as to cause the next following printing position of the printer, or the position of a print hammer, to fall on the succeeding line of the tab on which printing is to be continued. Since, however, it is impossible to define precisely the print position corresponding to a hammer which is held in the printer, the point on the succeeding space of the tab at which printing is to be resumed, is sometimes displaced from the prescribed printing location.

SUMMARY OF THE INVENTION

An object of the present invention is to provide a printing apparatus, which can impress a setting mark on a recording sheet when the sheet is removed after printing is temporarily suspended, and printing is to be continued on the succeeding line of the sheet after it is reloaded in the apparatus.

Accordingly, the present invention provides a printing apparatus capable of impressing a setting mark on a recording sheet, which comprises keyboard means including numerical keys for inputting numerical data, and a subtotal-closing key for indicating the end of the input of the numerical data. A central processing unit is connected to the keyboard means and includes first memory means to store the numerical data entered by operation of the numerical keys. The central processing unit also includes second memory means to store a first instruction for feeding the recording sheet a certain distance after numerical data is transferred from the first memory means and in response to operation of the subtotal-closing key, and a second instruction for printing a setting mark on the recording sheet only after the sheet is feed the certain distance. Printing means coupled to the central processing unit includes a printer to print the numerical data and the setting mark on the recording sheet, buffer means to store the numerical data sent from the central processing unit, and control means for controlling the printer to print the numerical data and for causing the setting mark to be printed in response to the first instruction after the recording sheet is fed the certain distance relative to the printer, in response to the second instruction.

A printing apparatus embodying the invention which is arranged as described above, enables a recording sheet to be loaded by aligning a setting mark previously impressed on a recording sheet, at a prescribed point on the printing apparatus. Since, therefore, the recording sheet can be reloaded at an accurately defined point, the possibility that a line on which printing will resume is superposed on that on which data was previously impressed, or that the line of resumed printing is set widely apart from that of the preceding printing, is eliminated.

BRIEF DESCRIPTION OF THE DRAWING

FIG. 1 is a circuit diagram of a printing apparatus embodying the present invention;

FIG. 4 indicates a pattern of data printed on a recording sheet; and

DETAILED DESCRIPTION OF THE INVENTION

Figure 2A:
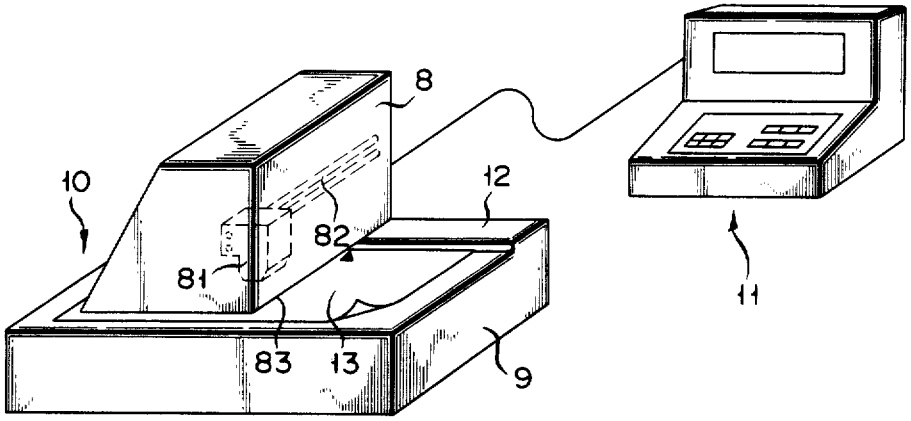
FIGS. 2A and 2B are, respectively, an oblique view of an electronic cash register, and an enlarged cross-sectional view of a printing section embodying the invention.

FIG. 1 is a schematic circuit diagram of a part of the subject printing apparatus. An input section 1 is provided with numerical keys 21, department keys 22, cash/amount key 23, receipts key 24, paid out key 25, credit key 26, sub-total key 27, subtotal-closing key 28 and mode switch 29 designating a mode, for example, registration (REG). The operation signal of the numerical key 21 is stored in the register of CPU2 as data, and CPU2 effects each step shown in the flow chart on FIG. 3 according to the operation signals of department keys 22. The CPU2 includes an A register and B register, and allows for transmission of data between a memory 3 on one hand and the A and B registers on the other, and sends printing data to a printing control section 4. The CPU2 is a CPU such as shown in U.S. Pat. No. 4,186,439 in FIG. 3A, the entire contents of U.S. Pat. No. 4,186,439 being incorporated by reference herein. The row address of the memory 3 which bears the order of i is divided into four memory regions Ri, Li, Pi and Zi. The memory region Ri stores a customer-distinguishing numeral. The memory region Li stores data on the sequential order of a line on the recording sheet on which printing is currently being continued. The memory region Pi stores data on the sequential order of a particular recording sheet on which printing is made for a given customer. The memory region Zi stores data on a subtotal for each customer. The CPU2 is connected to a memory 30 which stores data on the department/transaction. The printing control section 4 includes a buffer 6 and control means 7.

The buffer 6 stores the data of central processing unit 2 which is transferred from register A, and the control means 7 controls the printer 5 to print the data stored in buffer 6 onto the recording sheet. When an instruction for feeding for a predetermined distance is supplied from the CPU2, the recording sheet is fed for that predetermined distance. When an instruction for printing a setting mark on the recording sheet is supplied, the instruction is carried out.

The input section 1, CPU2, memory 3, and department/transaction memory 30 shown in FIG. 1 are held in the electronic cash register body 11 indicated FIG. 2A. The printing control section 4 and a printer 5 shown in FIG. 1 are held in the printing section 10. FIG. 2A is a schematic oblique view of the printing section 10, and the cash register body 11 connected to the printing section 10. A recording sheet 13 is mounted on the upper surface 12 of a generally rectangular printing table 9.

A paper printing block 8 is equipped with printing element 81. The printing element 81 is formed of a conventional wire dot type printing head or a typewriter. (The following description will be directed to a wire dot type printing head.) The printing element 81 has seven printing wires. Printing element 81 moves horizontally on guide number 82 so as to print one line of data on recording sheet 13. The recording sheet 13 is inserted from a recording sheet port 83 between the bottom plane of the paper printing block 8 and the upper surface 12 of the printing table 9.

Figure 2B:
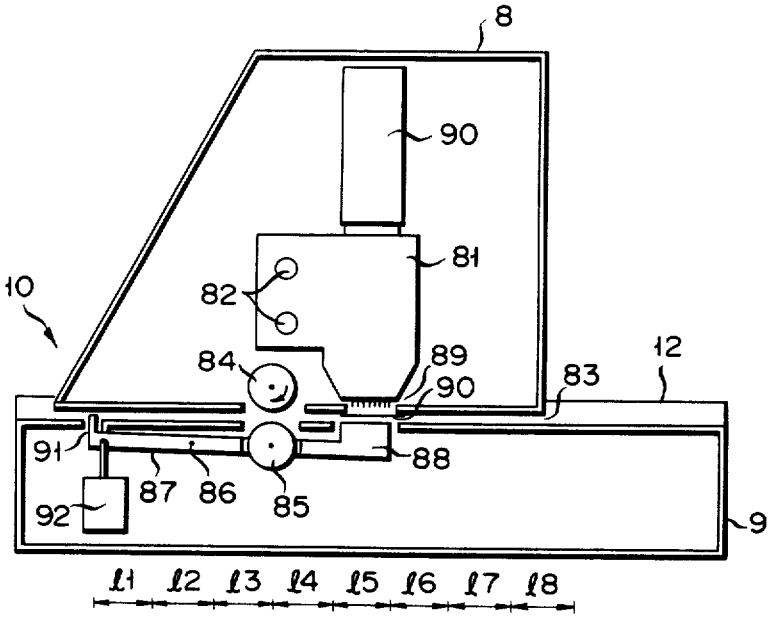

FIG. 2B is a cross-section of a conventional printing section 10 as manufactured, for example, by SHINSHU SEIKI KK in Japan and known as Epson M-540. Roller 85, which faces paper feed roller 84, is attached to member 87 which rotates about point 86. Platen 88, at the right end of member 87, faces wire dot head 89 of printing element 81 with an ink ribbon 90 interposed between the platen 88 and the dot head 89. On the left end of member 87 a projection is formed against which the leading edge of recording sheet 13 abuts. A gap is formed between the lower portion of paper printing block 8 and projection 91, through which recording sheet 13 passes when printing is started from the middle of the sheet rather than from the first line. Solenoid 92 operates to rotate member 87 about point 86 during printing.

In this state, recording sheet 13 is pressed against printing element 81 by platen 88, and printing is carried out. When one line of printing is completed, roller 84 which holds recording sheet 13 is rotated, and the sheet is fed by one line. Projection 91 retracts so as not to obstruct the advance of recording sheet 13.

In FIG. 2B, the distance from projection 91 to printing element 81 is $l_1+l_2+l_3+l_4$, so when the leading edge of recording sheet 13 abuts against projection 91, the initial data is printed on the 5th line $l_5$ from the leading edge. The distance from insertion port 83 for receiving the recording sheet 13, to printing element 81, is $l_6+l_7+(l_8/2)$.

A description now follows with reference to the accompanying drawing, of the operation of a printing apparatus embodying the invention.

Assume that a recording sheet is placed on the printing table 9 and is securely set with the leading edge of recording sheet 13 abutting against projection 91 in a printing starting position, by an operator. Then, mode switch 29 of input section 1 is set to the registration (REG) mode, and numerical key 21 is operated to input the data. This data is then supplied to the A register of CPU2. Next, when department key 22 is operated, CPU2 executes each step shown in the flow chart of FIG. 3.

Figure 3:
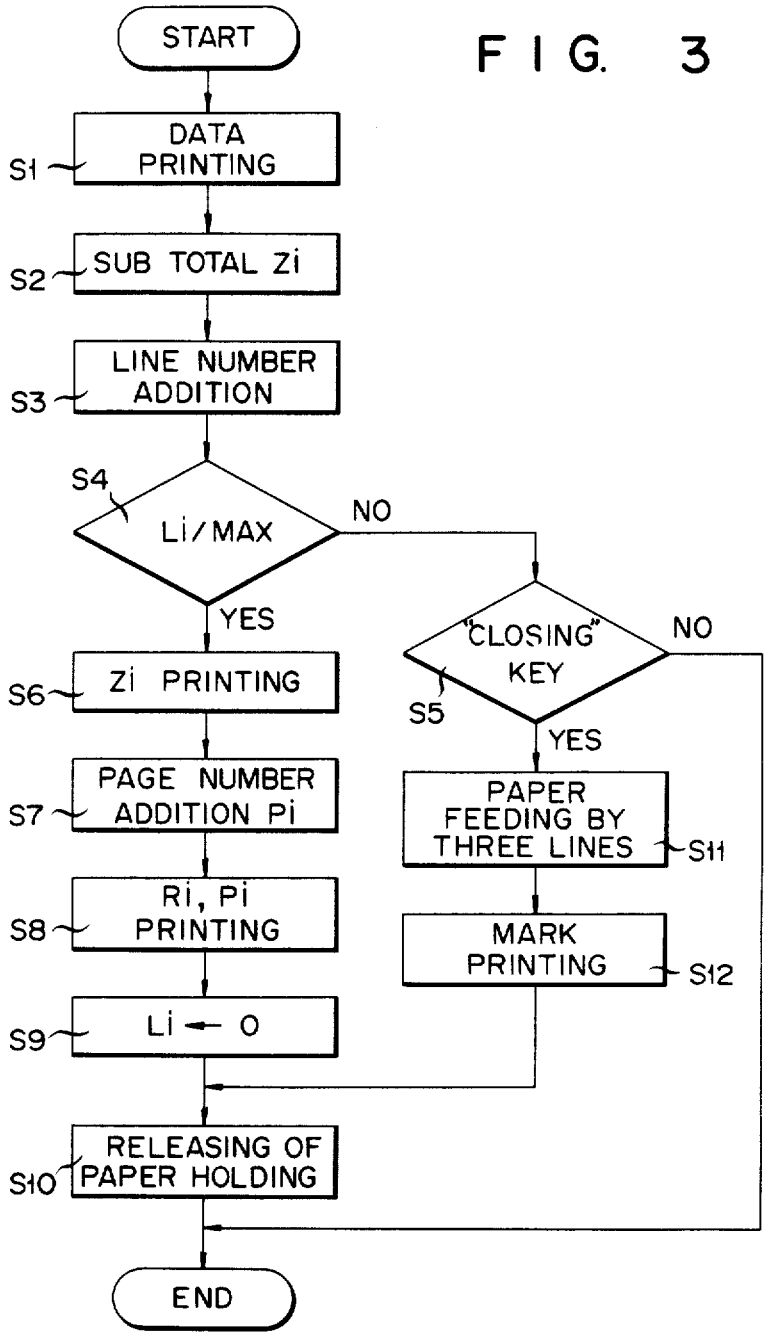
FIG. 3 is a flow chart illustrating the operation of the circuit of FIG. 1.

Sales data supplied in Step 1 is delivered to the printing control section 4 through CPU2. As a result, the printer 5 is actuated to print data on the recording sheet 13. In the succeeding Step 2, sales data supplied is added to the contents stored in the memory region Zi of the memory 3, thereby carrying out subtotaling. In the following Step 3, the region Li of the memory 3 stores data on the sequential order of a line on the recording sheet 13 on which printing is now being carried out. In Step 4, judgment is made to determine whether data on the sequential order of the line stored in the region Li of the memory 3 denotes MAX, that is, the sequential order of the final line on the recording sheet 13. In the case of "No", Step 5 ensues. In Step 5, judgment is made to determine whether the subtotal-closing key 28 of the input section 1 has been operated. In the case of "No", the whole series of steps shown in FIG. 3 is brought to an end. Each time any of the department keys 22 is actuated, Steps 1 to 5 are repeated. As shown on in FIG. 4, therefore, data up to [04.400] is printed on each line. When, in Step 4, it is judged that data on the sequential order of the line stored in the region Li of the memory 3 represents MAX, that is, a maximum number of lines on a recording sheet 13 on which printing can be made (generally, however, the last two lines are excluded to provide a blank space), then Step 6 ensues. In Step 6, data on a subtotal for each customer stored in the memory region Zi is supplied to the printing control section 4. At this time [2600 total] is printed on the recording sheet 13 as shown in FIG. 4. In Step 7, a number +1 is added to the data on the sequential order of a particular recording sheet 13 which has been stored in the region Pi of the memory 3 (addition of the page number by 1). In the Step 8, data [R-103] on a customer-distinguished numeral stored in the region Ri of the memory 3 and data [P-01] on the sequential order of the page stored in the region Pi of the memory 3 are printed on the aforementioned recording sheet 13 on which the subtotal of 2600 has already been printed. In Step 9, data is extinguished on the sequential order of the impression-bearing line on the recording sheet 13 which has been stored in the region Li of the memory 3. In Step 10, the holding of the recording sheet 13 is stopped. As a result, printing for a given customer on the recording sheet 13 is brought to an end as shown from FIG. 4, causing the recording sheet 13 to be taken off the printing table 9.

Figure 5A:
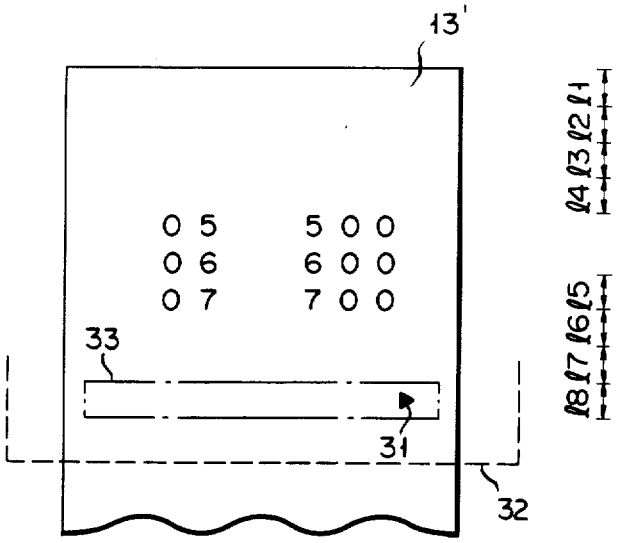
FIGS. 5A and 5B show, respectively, data previously printed on the recording sheet, illustrating the manner in which the position of a printing resumption point is to be defined.

Later, new recording sheet 13' is inserted between the printing table 9 and the paper printing block 8 by the operator. Thereafter, the entry key 21 and a selected one of the department keys 22 are operated in succession to register data on the sale to the customer. Then, Steps 1 to 5 are carried out in succession, causing data up to [07.007] to be printed on the recording sheet 13' as shown in FIG. 5A. Now let it be assumed that while printing occurs on the recording sheet 13', the subtotal-closing key 28 is operated to temporarily suspend registration for the customer. In this case, it is judged in Step 5 that the subtotal-closing key 28 has been operated.

Step 11 then ensues, in which the CPU sends three lines of paper feed instructions to the printing section 10. These instructions are decoded by converter 7, and three lines of paper feed signals are sent to printer 5. Consequently, the recording sheet 13' is moved forward to an extent of three lines. In the succeeding Step 12, a setting mark 31 is printed at the end portion of the recording sheet 13' which is apart by three lines from the last printed data as shown in FIG. 5A. In FIG. 5A, the position of printing block 8 is delineated at 32, and the position of printing element 81 is outlined at 33. In the drawing, recording sheet 13' has been fed for three lines and the setting mark 31 then printed. In Step 10, the recording sheet 13' is taken off the printing table 9.

Figure 5B:
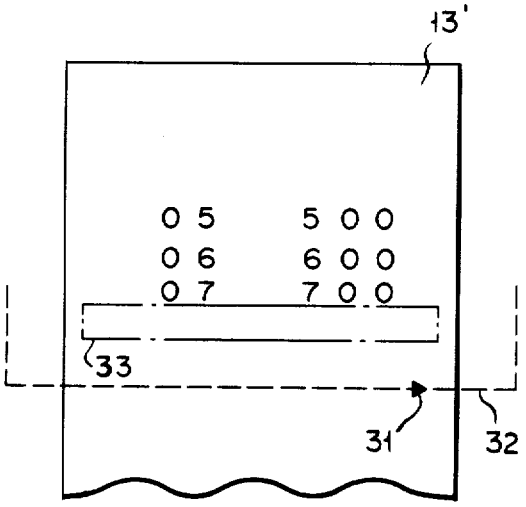

When, after the impression of the setting mark 31 on the recording sheet 13', goods newly bought by the customer are registered, then the recording sheet 13' is again mounted on the printing table 9. At this time, the recording sheet 13' is securely placed on the printing table 9 with the position of the recording sheet 13' determined by causing the setting mark 31 impressed on the recording sheet 13' to closely face the edge of that side of the bottom plane of the paper printing block 8 toward which the recording sheet 13' is made to travel. Consequently, the bottom plane of the printing block 8 falls within a range surrounded by dashed lines 32 as shown in FIG. 5B. Further, the printing element is positioned in a region defined by dot-dash lines 33 indicated in FIG. 5B. When, therefore, the entry key 21 and a selected one of the department keys 22 are actuated, the first data of the current printing is impressed in succession relative to the data last printed on the recording sheet 13' in the preceding printing step.

In the foregoing embodiment, the setting mark 31 was printed, after the recording sheet 13' was carried forward to an extent of three lines. However, it is preferred to define the number of lines, to the extent of which the recording sheet 13' is shifted, in accordance with the relative positions of the printing position-indicating means and printer.

Further, the setting mark 31 was made to closely face the edge of that side of the bottom plane of the paper printing block 8 toward which the recording sheet is made to travel. It is possible, however, to let the setting mark 31 face not only the paper printing block 8, but also the proper section of the printing section or a specially provided indicator. That is, printing position-indicating means which is to be faced by the setting mark 31 should preferrably be fixed in the printing section.

What is claimed is:

1. A printing apparatus for enabling a setting mark to be impressed on a recording sheet, comprising:

keyboard means including at least numerical keys for inputting numerical data, and a subtotal-closing key for indicating the end of the input of the numerical data;

a central processing unit connected to the keyboard means and including first memory means for storing the numerical data entered by operation of said numerical keys, and second memory means for storing a first instruction for feeding the recording sheet a pre-determined distance after numerical data is transferred from said first memory means and in response to operation of said subtotal-closing key, and a second instruction for printing a setting mark on the recording sheet only after the recording sheet is fed said pre-determined distance; and printing means connected to the central processing unit, said printing means including a printer for imprinting the numerical data and the setting mark on the recording sheet, buffer means for storing the numerical data transmitted from said central processing unit, and control means for controlling said printer to print the numerical data and for causing the setting mark to be printed in response to said first instruction after the recording sheet is fed said pre-determined distance relative to said printer in response to said second instruction.

2. The printing apparatus according to claim 1, wherein said printer includes a printing element and said printing means has an insertion port a certain distance from said printing element for receiving the recording sheet, and said printer control means is operative to control said printer so that the recording sheet is fed only said pre-determined distance which is greater than the distance between the insertion port and said printing element of said printer, prior to printing of the setting mark.

3. The printing apparatus according to claim 1, wherein said printer operates to print successive lines of the numerical data on the recording sheet with said printing element so that adjacent data lines are spaced apart a certain amount one below the other, and said printer control means is operative to print the setting mark a certain distance below the last printed data line on the recording sheet so that said printing element is aligned with the next successive data line after the last printed data line on the recording sheet when the recording sheet is reinserted in said printer and the setting mark is aligned with indication means provided with said printing means.

4. The printing apparatus according to claim 3, wherein said indication means comprises an edge of said insertion port.

5. The printing apparatus according to claim 3, wherein said indication means comprises an indicator fixed to said printing means.

6. The printing apparatus according to claim 1, concluding third memory means which is provided with a first region for storing at least data on the sequential order of a line on the recording sheet on which printing is currently being made and a second memory region for storing data on a subtotal for a given customer, first judging means for judging if data has been stored in said first memory region on the sequential order of a line the same as that of a last line on the recording sheet, and means coupled to said first judging means and said second memory region for supplying data on a subtotal for a given customer to the printing means through the central processing unit.

7. The printing apparatus according to claim 6, wherein the third memory means is provided with a third memory region for storing data on the sequential order of a page of the recording sheet on which printing has just previously been made, second judging means for judging if data is stored in the first memory region on the sequential order of an impression-bearing line the same as that of the last line on the recording sheet, and means coupled to said second judging means and said third memory region for supplying data on the sequential order of an impression-bearing page readout from the third memory region to the printing means through the central processing unit.

* * * * *